United States Patent [19]

Brady

[11] 4,252,388

[45] Feb. 24, 1981

[54] HIGH POWER SLIP RING ASSEMBLY

[75] Inventor: Sherwin L. Brady, Floyd, Va.

[73] Assignee: Litton Systems, Inc., Blacksburg, Va.

[21] Appl. No.: 41,262

[22] Filed: May 21, 1979

[51] Int. Cl.[3] ..... H01R 39/00

[52] U.S. Cl. ..... 339/5 M

[58] Field of Search ..... 339/5 M, 5 R, 5 S, 22 B, 339/118 R, 118 RY, 182 RS, 176 T

[56] References Cited

U.S. PATENT DOCUMENTS

| | | | |
|---|---|---|---|
| 2,931,999 | 4/1960 | Lemmerman | 339/5 M |
| 3,316,519 | 4/1967 | Maytone | 339/5 M |
| 4,142,767 | 3/1979 | Karl et al. | 339/1 |

*Primary Examiner*—Neil Abrams

*Attorney, Agent, or Firm*—Brian L. Ribando; C. Frederick Koenig, III

[57] ABSTRACT

A slip ring mounted in a buoy is used to transmit power from a generating vessel to an offshore installation. The vessel is moored to the buoy and the slip ring acts as an electric swivel allowing the vessel to weathervane around the buoy as environmental conditions may require. The slip ring conducts high voltage three phase power and an open ring stack allows circulation of high dielectric insulating oil therethrough. The insulating oil allows the ring stack to have smaller dimensions than would be possible if an air dielectric were used. Access ports and viewing windows enable maintenance to be performed on the ring without removing the outer housing.

4 Claims, 4 Drawing Figures

HIGH POWER SLIP RING ASSEMBLY

BACKGROUND OF THE INVENTION

The invention relates to a high powered slip ring for use in transmitting power from a floating vessel to a stationary structure.

Floating vessels with power generating capacity are used as a power source for offshore equipment. The vessel may be moored to a buoy which is remote from the equipment, and a cable may be extended from the buoy to the place where the power is needed. Winds and tides cause the floating vessel to weathervane about the buoy which is fixed by some means to the sea bottom, and for this reason, an electrical swivel is required to transmit the power generated on the vessel to the nonrotating cable. The power rating of such an electrical swivel must be high as the generation of three phase power at 35 KV and 600 amps per phase is sometimes required.

The U.S. Patent to Karl et al, No. 4,142,767, shows a swivel assembly which may be used for carrying oil or other cargo and transmitting electrical power and signal currents between the floating vessel and a stationary installation. The Karl et al patent does not show structure by which high voltage power could be transmitted.

SUMMARY AND OBJECTS OF THE INVENTION

A slip ring assembly may be mounted in an anchored buoy and used to transmit power from a floating generating vessel to an offshore installation. A subsea cable is used to connect the slip ring to the installation, and the slip ring acts as an electric swivel to allow the floating vessel to weathervane around the buoy as may be required. The slip ring conducts three phase high voltage power through an open stack of rings to spaced brushes which are connected to the subsea cable. Insulating oil completely fills a chamber in which the ring stack is located, which oil has a breakdown voltage which is more than 4 times greater than the breakdown voltage of air, thus allowing the assembly to have smaller dimensions than would otherwise be required. The insulating oil is able to be sampled, filtered, and changed without emptying the chamber, and access ports and viewing windows enable additional maintenance to be performed on the ring without removing the outer surrounding housing.

It is therefore an object of the invention to provide a high power slip ring for use in transmitting power from a floating vessel to an offshore installation.

It is another object of the invention to provide a high power open stack slip ring which is filled with insulating oil and which conducts three phase power from a floating generating vessel to an offshore installation.

These and other objects of the invention will become apparent from the following detailed description taken in conjunction with the accompanying drawing figures in which like reference numerals designate like or corresponding parts throughout the figures.

DESCRIPTION OF THE PREFERRED EMBODIMENT

Figure 1:
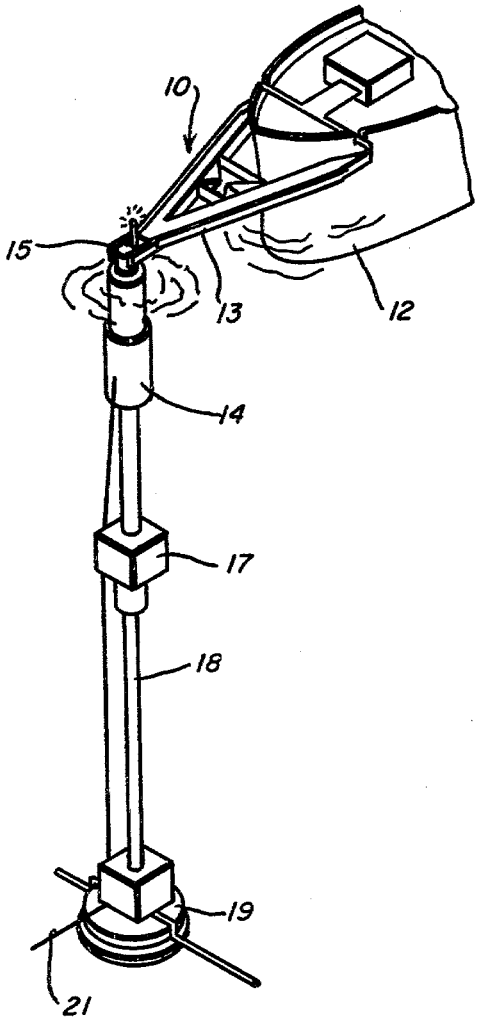
FIG. 1 shows the installation environment for a high powered slip ring mounted in a buoy.

Referring now to the drawings, there is shown in FIG. 1 a typical installation site designated by the reference numeral 10. As shown, a floating vessel 12 may be moored by means of a yoke 13 to a mooring buoy 14. The connection between the yoke 13 and the buoy 14 includes a swivel joint 15 to allow the vessel 12 to weathervane around the buoy 14. Beneath the buoy 14 is a universal joint 17 and a riser 18 which is connected to a mooring base 19. A subsea cable 21 is connected to the mooring buoy 14 at one end and to an offshore installation (not shown) at the other end. A slip ring assembly is mounted within the buoy 14 for coupling the subsea cable 21 to a high voltage power cable from the vessel 12.

Figure 2:
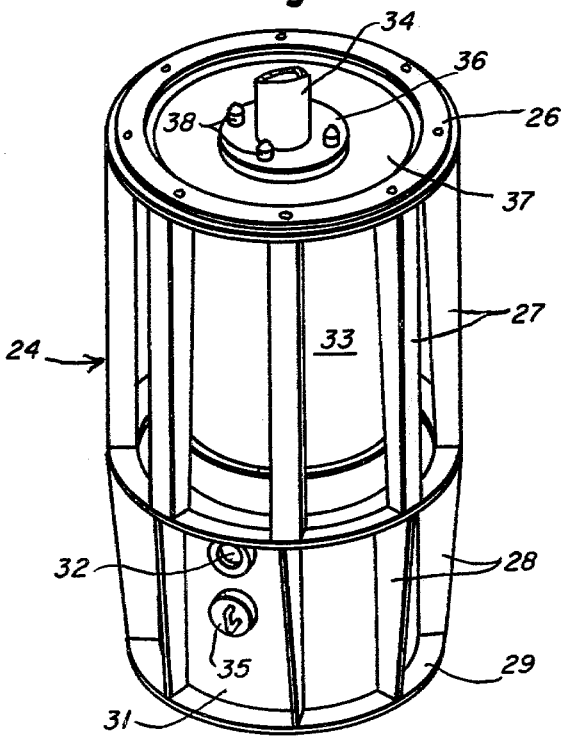
FIG. 2 is a perspective view of the slip ring of the instant invention.

Turning now to FIG. 2, a high powered slip ring assembly is generally designated by the reference numeral 24. This slip ring assembly comprises an upper support ring 26 by means of which the assembly may be supported, and a plurality of upper support spacers 27 depending therefrom. Lower support spacers 28 terminate in a base ring 29, and a stator housing 31 is provided with windows 32 and access ports 35 which allow visual inspection and maintenance of the slip ring interior to be made without disassembly of the stator housing 31.

The slip ring rotor includes an upper junction box 33 which is located within the upper support spacers 27. A power cable conduit 34 including a drive flange 36 may be coupled to the top portion 37 of the junction box 33. Rotation of the conduit 34 is transmitted to the upper junction box 33 by the drive flange 36 through a plurality of drive pins 38.

Figure 3:
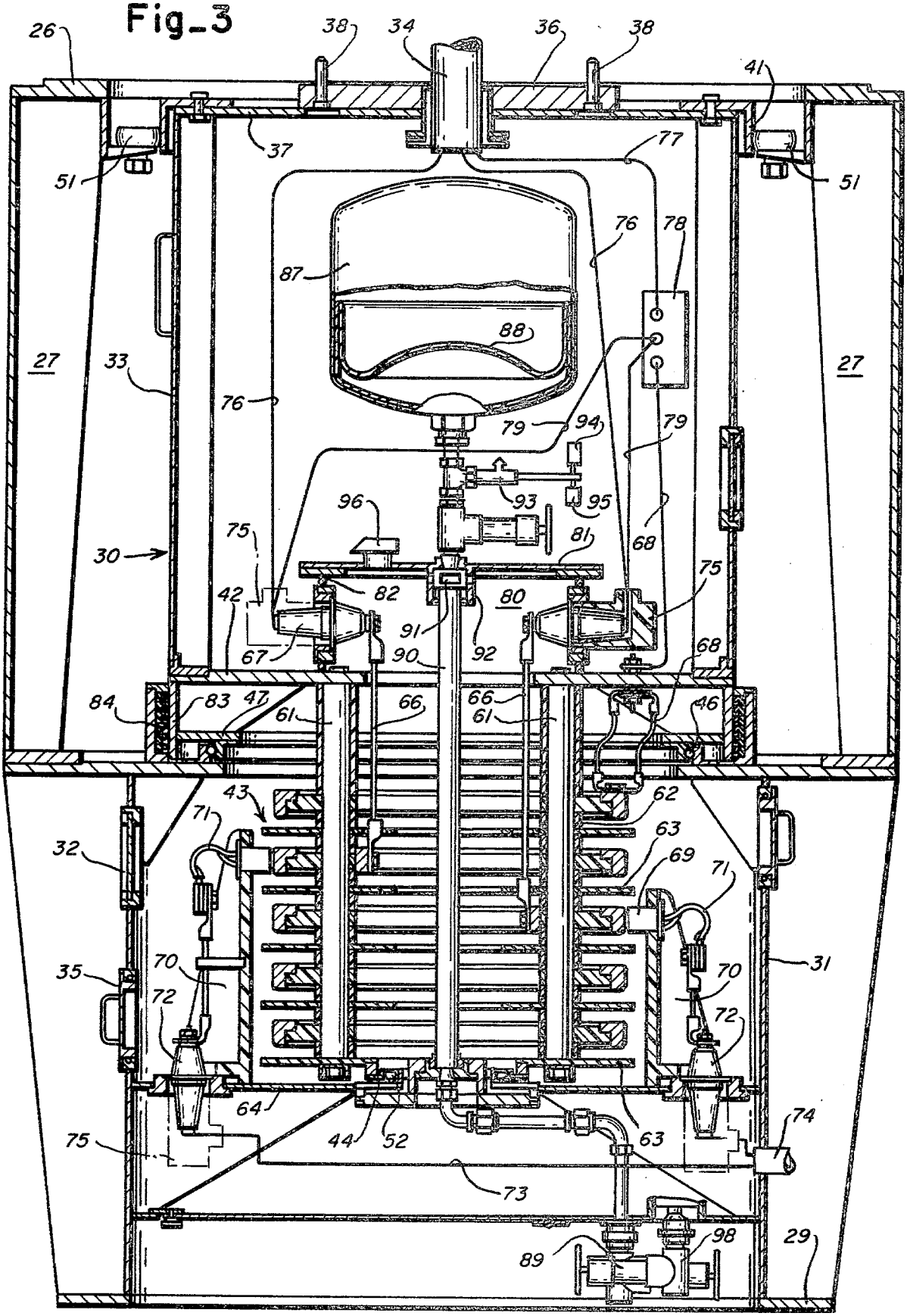
FIG. 3 is a sectional view of the slip ring of FIG. 2.
Figure 4:
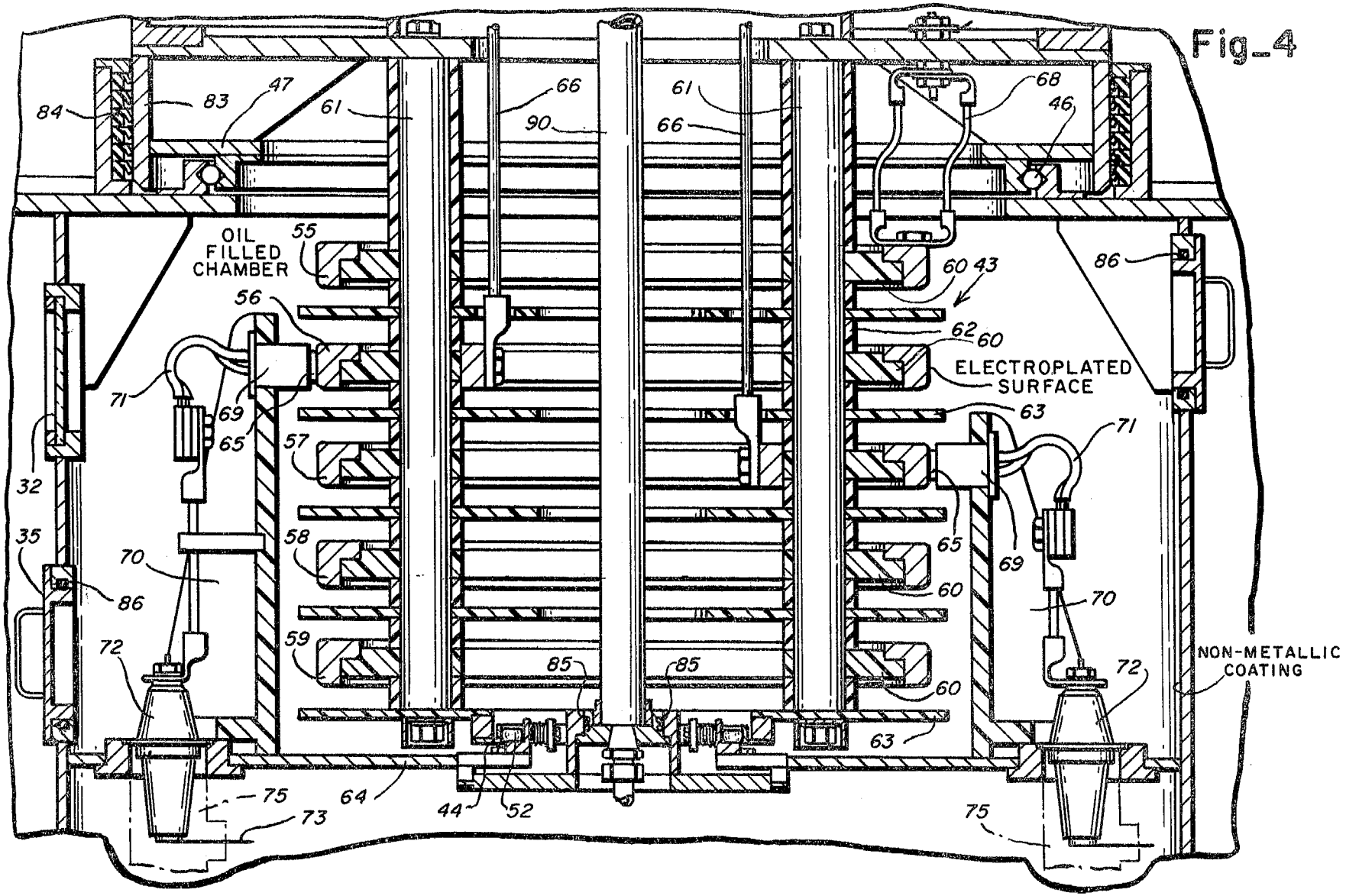
FIG. 4 is an enlargement of a portion of the sectional view of FIG. 3.

Turning now to FIGS. 3 and 4, it will be seen that the rotor structure generally designated by the reference numeral 30 of the slip ring 24 includes the upper junction box 33, an upper rotor flange 41, a ring stack support plate 42, the ring stack 43, and a lower rotor flange 44. The main bearing 46 for the rotor 30 is mounted between a rotor bearing plate 47 and a stator bearing plate 48 to provide the main support for the rotor. Upper rollers 51 bear on the upper rotor flange 41 and lower rollers 52 bear on the lower rotor flange 44 to provide additional lateral support when the axis of the rotor 30 deviates from the vertical.

The ring stack 43 comprises a plurality of conductive rings 55, 56, 57, 58 and 59 which are each mounted by dielectric support brackets 60 on dielectric support rods 61 alternately with washer-like dielectric barriers 63. The rings and barriers are maintained spaced from one another by dielectric support spacers 62 on each rod 61 to allow the insulating fluid to freely flow between the annular rings and barriers into the interior of the ring stack. The washer-like dielectric barriers 63 block arcing paths which would otherwise exist between adjacent rings or between the bottom ring 59 and chamber floor 64.

Three phase power may be coupled to the ring stack by means of buss connectors 66 which extend from rotor power terminals 67. Rings 56, 57 and 58 may be coupled to individual rotor power terminals 67 while the ring 59 may be used as a spare ring. The ring 55 acts as a bonding ring and couples ground leads 68 to earth through a suitable brush lead (not shown). Power surges on the ground circuit, such as a lightning bolt which may strike the outer portion of the buoy, are conducted to ground through the ground leads 68 and the bonding ring 55 rather than through the main bearing 46.

Each ring 55–59 is contacted by a brush 65 mounted in a brush holder 69, and the several brush holders are spaced around the circumference of the ring stack 43 on individual supports 70 in order to increase the spacing therebetween to prevent against arcing. Each brush is connected by means of a brush lead 71 to a stator power terminal 72. Cables 73 are connected through high voltage connectors 75 to the power terminals 72, and are collected and routed to a subsea cable by means of a power conduit 74.

Shielded power leads 76 are connected to each of the rotor power terminals 67 through high voltage connectors 75, and a power cable ground 77 is connected to a ground terminal 78. Ground connections 79 from each of the shielded power leads 76 may also be connected to the ground terminal 78, and the coupling thereof through the ground leads 68 to the bonding ring 55 provides a circuit path through the slip ring to ground.

The ring stack 43 is disposed in an oil filled chamber 80. This chamber comprises a top portion 81, cylindrical side wall 82, the stack support plate 42, a seal wall 83, the stator housing 31, and the chamber floor 64. A large circumference lip-type oil seal 84 is provided on the rotor seal wall 82, and small diameter O-ring seals 85 and 86, best seen in FIG. 4, are provided at the base of the stator structure and the access ports, respectively.

A reserve supply of oil for the oil filled chamber 80 is maintained within a collapsible bladder 88 which lines the interior of a reservoir 87. The bladder 88 allows the oil level within the reservoir 87 to rise and fall in response to the expansion or contraction of the oil due to temperature changes. Oil within the chamber 80 may be sampled by means of the valve assembly 89 located in the base of the slip ring. If the oil within the chamber is low, an oil fill tube 90 coupled to the fill valve assembly 98 may be used to admit oil to the interior of the chamber 80 through a plurality of ports 91 formed in a sleeve 92 which centers tube 90 in the ring stack 43. An oil level sensor 93 provides an alarm when the oil supply within the reservoir 87 is depleted, and a pressure relief valve 94 may be provided to safeguard against high pressure due to an excess quantity of oil being delivered to the reservoir. A vent valve 95 accommodates the filling and draining the chamber 80 with oil. A large pressure relief device 96 is provided in the event that a transient spark at the ring stack causes a sudden large increase of pressure within the chamber 80.

The presence of the insulating oil in the chamber 80, which for example, may be Exxon UNIVOLT TM N61 insulating oil, allows the spacing between the individual rings 55–59 and between the other conductive structure within the chamber 80 to be less than would otherwise be possible. The breakdown voltage of the insulating oil may be 35 K per one-tenth inch, or more than 4 times greater than the breakdown voltage of air. The open structure of the stack 43 allows the oil within the chamber 80 to circulate freely therethrough. The construction of the hollow rings 55–59 separated by the spacers 62 and the washer-like barriers 63 maintains the center of the stack 43 open, and the individual supports 70 for the brush block holders 69 further insures the circulation of oil.

Metals which are used in the slip ring assembly can react with various components of the insulating oil causing the insulating ability of the oil to decrease. Copper is one of the metals which causes the reaction to proceed most rapidly, but because of copper's high electrical conductivity, the rings 55–59 and other components in the slip ring assembly are made of copper. To prevent rapid oil degradation and to prolong the operational life, exposed reactive metal surfaces are covered with non-metallic organic coatings and non-reactive metallic platings. For this purpose, epoxies and phenolics may be used as coatings on metal surfaces which are not required to be conductive, such as the chamber components 81, 82, 42, 83, 31, 64, and the like, and silver or nickel may be electrodeposited on the copper rings and other components of the assembly which are required to be conductive.

Having thus described the invention, various modifications and alterations thereof will occur to those skilled in the art, which modifications and alterations are intended to be within the scope of the invention as defined in the appended claims.

I claim:

1. A high voltage slip ring assembly adapted to be filled with insulating fluid during operational usage comprising:

a stator, a rotor rotatably mounted to said stator and defining a chamber annular seal means operatively sealing said chamber for retaining insulating fluid therein, a non-reactive interior coating on the interior surfaces of said chamber for preventing degradation of the insulating fluid, rotary electrical coupling means for coupling high voltage three-phase power from an input cable mounted to said rotor through said chamber to an output cable mounted to said stator, said coupling means including an open cylindrical ring stack within said chamber rigidly mounted to said rotor, said stack comprising a plurality of conductive rings having non-reactive metal surfaces for preventing insulating fluid degradation, a plurality of dielectric washer-like barriers, a plurality of dielectric supporting rods on which said conductive rings and said ring barriers are alternately mounted in a cylindrical array, and selected axial spaces between each said conductive ring and each said washer-like barrier forming radial passages for allowing fluid to circulate therebetween into the interior of and throughout said open ring stack, said fluid circulation preventing isolated areas of heat build-up in the insulating fluid and preventing gaseous bubbles from being trapped along surfaces of said stack whereby short circuiting and arcing between said conductive rings is prevented during operational usage of said slip ring assembly.

2. A high voltage slip ring assembly according to claim 1 further comprising:

a main bearing assembly supporting said rotor for rotation with respect to said stator, and a plurality of rollers between said rotor and said stator for providing additional support for said rotor.

3. A high voltage slip ring assembly according to claim 2 further comprising:

a reservoir means connected to said chamber containing a reserve supply of insulating fluid and allowing the insulating fluid to expand and contract in response to ambient temperature changes.

4. A high voltage slip ring assembly according to claim 2 wherein said electrical coupling means additionally comprises a ground circuit between said input cable and said output cable which includes a bonding ring comprising one of said conductive rings for preventing electrical discharge through said main bearing assembly.

* * * * *